US006787213B1

(12) United States Patent
Beuther et al.

(10) Patent No.: US 6,787,213 B1
(45) Date of Patent: Sep. 7, 2004

(54) SMOOTH BULKY CREPED PAPER PRODUCT

(75) Inventors: Paul D. Beuther, Neenah, WI (US); Richard J. Kamps, Wrightstown, WI (US); Kurt W. Ostermeier, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 720 days.

(21) Appl. No.: 09/223,602

(22) Filed: Dec. 30, 1998

(51) Int. Cl.[7] ..... B31F 1/12
(52) U.S. Cl. ..... 428/152; 428/153; 162/111
(58) Field of Search ..... 162/111, 112, 162/113, 123, 125, 129, 131, 132, 133; 428/152, 153, 154

(56) References Cited

U.S. PATENT DOCUMENTS

| | | | | | |
|---|---|---|---|---|---|
| 3,262,840 | A | | 7/1966 | Hervey | 162/205 |
| 3,812,000 | A | * | 5/1974 | Salvucci, Jr. et al. | 162/111 |
| 3,981,084 | A | | 9/1976 | Sobota | 34/123 |
| 4,055,461 | A | | 10/1977 | Turunen | 162/290 |
| 4,141,388 | A | | 2/1979 | Romanski et al. | 139/383 |
| 4,166,001 | A | | 8/1979 | Dunning et al. | 162/111 |
| 4,238,284 | A | | 12/1980 | Huostila et al. | 162/207 |
| 4,261,392 | A | | 4/1981 | Westhead | 139/383 |
| 4,300,981 | A | | 11/1981 | Carstens | 162/109 |
| 4,357,758 | A | | 11/1982 | Lampinen | 34/9 |
| 4,420,372 | A | | 12/1983 | Hostetler | 162/280 |
| 4,483,745 | A | | 11/1984 | Wicks et al. | 162/205 |
| 4,556,450 | A | | 12/1985 | Chuang et al. | 162/204 |
| 4,662,992 | A | | 5/1987 | Mirsberger | 162/203 |
| 4,861,430 | A | | 8/1989 | Andersson | 162/205 |
| 4,874,470 | A | | 10/1989 | Skaugen | 162/360 |
| 4,922,627 | A | | 5/1990 | Romero Hernandez | 34/116 |
| 4,942,077 | A | | 7/1990 | Wendt et al. | 428/152 |
| 5,127,168 | A | | 7/1992 | Pikulik | 34/18 |
| 5,500,092 | A | | 3/1996 | Schiel | 162/358 |
| 5,503,196 | A | | 4/1996 | Josef et al. | 139/383 |
| 5,549,790 | A | | 8/1996 | Van Phan | 162/109 |
| 5,553,393 | A | | 9/1996 | Korhonen et al. | 34/117 |
| 5,556,509 | A | | 9/1996 | Trokhan et al. | 162/111 |
| 5,607,551 | A | * | 3/1997 | Farrington, Jr. et al. | 162/109 |
| 5,609,936 | A | | 3/1997 | Kohler et al. | 428/107 |
| 5,667,636 | A | | 9/1997 | Engel et al. | 162/117 |
| 5,674,590 | A | * | 10/1997 | Anderson et al. | 428/154 |
| 5,728,268 | A | | 3/1998 | Weisman et al. | 162/109 |
| 5,776,312 | A | | 7/1998 | Trokhan et al. | 162/358.2 |
| 5,778,555 | A | | 7/1998 | Lehtinen et al. | 34/71 |
| 5,814,190 | A | | 9/1998 | Van Phan | 162/111 |
| 5,874,156 | A | * | 2/1999 | Schulz | 428/156 |

* cited by examiner

*Primary Examiner*—Harold Pyon
*Assistant Examiner*—Alicia Chevalier
(74) *Attorney, Agent, or Firm*—Brinks Hofer Gilson & Lione

(57) ABSTRACT

A uniformly smooth Yankee side tissue product is provided. This tissue has the bulk of a creped tissue product but with a substantially smoother Yankee side surface of the sheet.

5 Claims, 9 Drawing Sheets

SMOOTH BULKY CREPED PAPER PRODUCT

BACKGROUND OF THE INVENTION

It has long been desirable in the manufacture of tissue paper to increase bulk. Increased bulk provides economic advantages, product performance advantages, and customer preference advantages to the tissue product.

The bulk of a paper sheet is inversely related to the density of the sheet. As the density of the sheet decreases, i.e., density values become smaller, the bulk of the sheet would increase. The density of a paper sheet may be measured as grams per centimeter cube ($g/cm^3$) or similar weight over volume measurement. Bulk measurements for tissues are typically reported as $cm^3/g$.

It has long been known in the paper making arts that increased bulk can be obtained by adhering a wet web of paper fibers to the surface of a Yankee dryer, or other similar smooth drying surface, drying the web to form a paper sheet and then creping the paper sheet from the dryer surface. Creping, however, can result in certain undesirable side effects. In particular, creping increases the roughness of the sheet by creating a surface contour having a series of ridges and troughs (hills and valleys) running across the width (cross-machine direction) of the sheet. Thus, a creped sheet may feel rough, if not very rough, to a user of the tissue.

The present invention provides a new and useful way in which to obtain the increased bulk of a creped tissue, while avoiding the surface roughness associated with creping.

SUMMARY OF THE INVENTION

In an embodiment of this invention, there is provided a tissue made by creping a sheet of paper making fibers from a Yankee dryer; the sheet further comprising: a first side and a second side; the first side being in contact with the surface of the Yankee dryer; the second side being positioned away from the surface of the Yankee dryer; the first side of the sheet having a surface, said surface having a uniformly smooth appearance; a bulk of at least (i.e., greater than or equal to) about 6 $cm^3/g$ at least about 7 $cm^3/g$, or at least about 8 $cm^3/g$; and, a stretch of at least about 10% in the machine direction. This tissue may have the second side of the sheet comprising a creped pattern. This tissue may also be a blended single layer sheet.

In another embodiment of this invention there is provided a multi-ply tissue product having a smooth outer surface comprising: a first base sheet made by creping a sheet of material from a Yankee dryer; the base sheet further comprising: a first side and a second side; the first side being in contact with the surface of the Yankee dryer; the second side being positioned away from the surface of the Yankee dryer; the first side of the base sheet having a smooth surface substantially free from any creped pattern; and, the second side of the base sheet having a creped pattern, a second base sheet; the first and second base sheets being positioned together to form a multi-ply product; and, the first side of the first base sheet constituting the smooth outer surface of the multi-ply tissue. This multi-ply tissue may have the second base sheet further made by creping the base sheet from a Yankee dryer; the base sheet further comprising: a first side and a second side; the first side being in contact with the surface of the Yankee dryer; the second side being positioned away from the surface of the Yankee dryer; the first side of the base sheet having a smooth surface; and, the second side of the base sheet having a creped pattern.

In yet a further embodiment there is provided single layer base tissue sheet having a basis weight from about 10 to 25 gsm, a bulk of from about 6 $cm^3/g$ to about 15 $cm^3/g$, and a stretch of from about 10% to about 50% in the machine direction; and comprising a Yankee side and an off-Yankee side; the Yankee side having a smooth surface, substantially free from any discernable crepe pattern.

In yet another embodiment there is provided a multilayer tissue made by creping the tissue from a dryer and further comprising: a top and a bottom layer; the bottom layer comprising: a first side; the first side being in contact with the surface of the Yankee dryer; the first side having a uniformly smooth surface; the top layer comprising; a second side; the second side being positioned away from the surface of the Yankee dryer; the second side having a creped pattern.

DRAWINGS

FIG. 1 is a schematic process flow diagram generally showing the manufacture of tissue paper products.

FIGS. 2A and B are photographs of the Yankee side surface of paper sheets made pursuant to the present invention. The lighting is oriented in the machine direction.

DETAILED DESCRIPTION OF PRESENTLY PREFERRED EMBODIMENTS OF THE INVENTION

Figure 1:
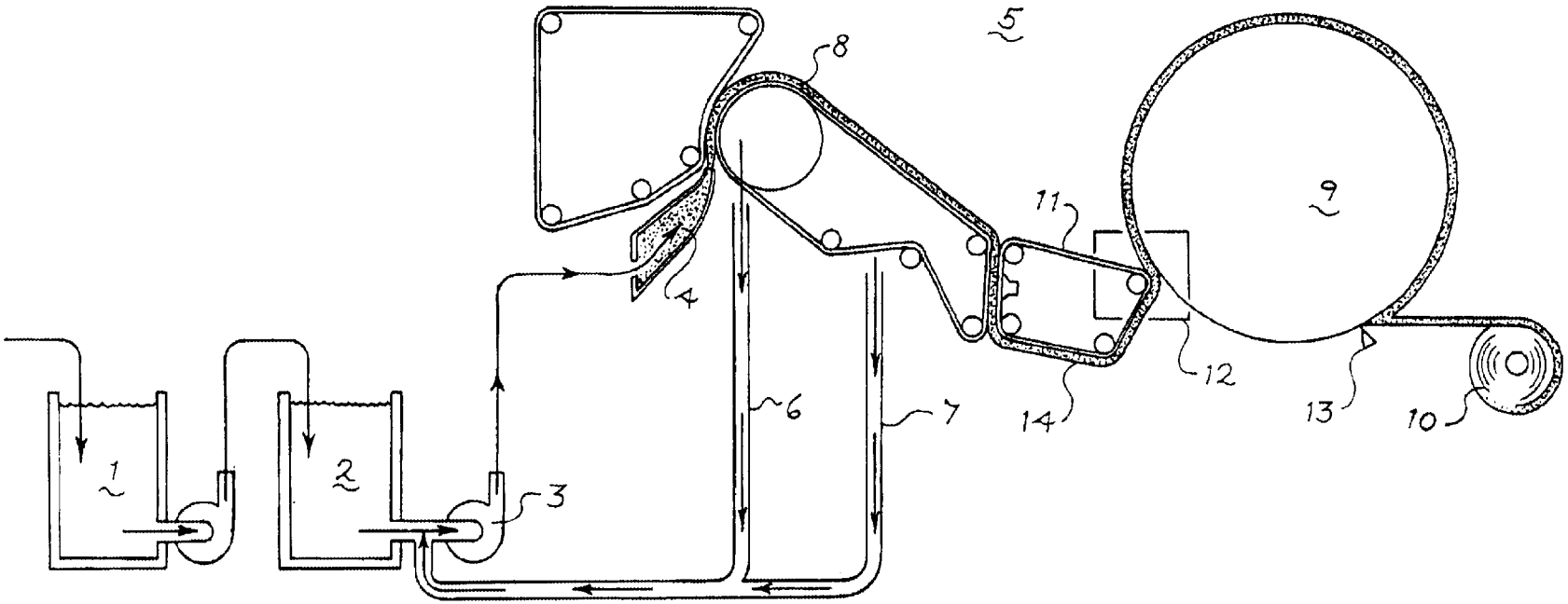

Referring to FIG. 1, which is a schematic process flow diagram of a paper making process, cellulose fibers are prepared in a pulper (not shown) to form an aqueous slurry of fibers and water, which is referred to as stock or a stock solution. The stock is pumped into a chest 1, which may be referred to as a dump chest. From the dump chest the stock is pumped to another holding chest 2, which may be referred to as a machine chest. From the machine chest the stock is pumped by the fan pump 3 to the head box 4 of the paper making machine 5. At or before the fan pump, the stock is diluted with water. Usually, and preferably, the dilution is done with return water, referred to as white water, from the paper making machine. The flow of the white water is shown by lines 6 and 7. Prior to dilution the stock is referred to as thick stock, and after dilution the stock is referred to as thin stock.

The thin stock is then dewatered by the forming section 8 of the paper machine to form an embryonic web of wet cellulose fibers. The wet web is then transferred to a dryer 9, which removes water from the wet web forming a paper sheet. The dryer 9 may be a Yankee dryer or other similar dryer having a smooth drying surface. The paper sheet is then creped from the dryer by doctor or creping blade 13. The paper sheet is then wound on reel 10. The area of transfer (shown by box 12) of the wet web to the dryer surface and the manner in which the wet web is transferred to and adhered to the dryer surface, are set forth in detail below. The direction of the sheet as it moves through the apparatus is referred to as the machine direction. Thus, the machine direction of the sheet would coincide with a line parallel to the direction that the sheet moved through the paper making machine. The cross-machine direction would be transverse to the machine direction.

It is to be understood that FIG. 1 is a general description of the paper making process and is meant to illustrate that process and is in no way meant to limit or narrow the scope of the present invention. Many variations in this process and equipment are known to those skilled in the art of paper making. Although the schematic generally shows a twin wire type forming section, other forming sections known to the art may be used. Additional components may also be added or removed from the process. For example, screens, filters and refiners, which are not illustrated, may be typically placed between the pulper and the head box. The transfer section 14 of the paper machine may not be present or may be expanded to include additional water removal devices. Additional steps may also be added on-machine after the dryer and before the reel, such as the use of a size press, although additional drying is usually required after a size press application is used. Coating operations may also be conducted off-machine. Additionally, the process of creping the sheet from a dryer surface may be performed off-machine.

Figure 6:
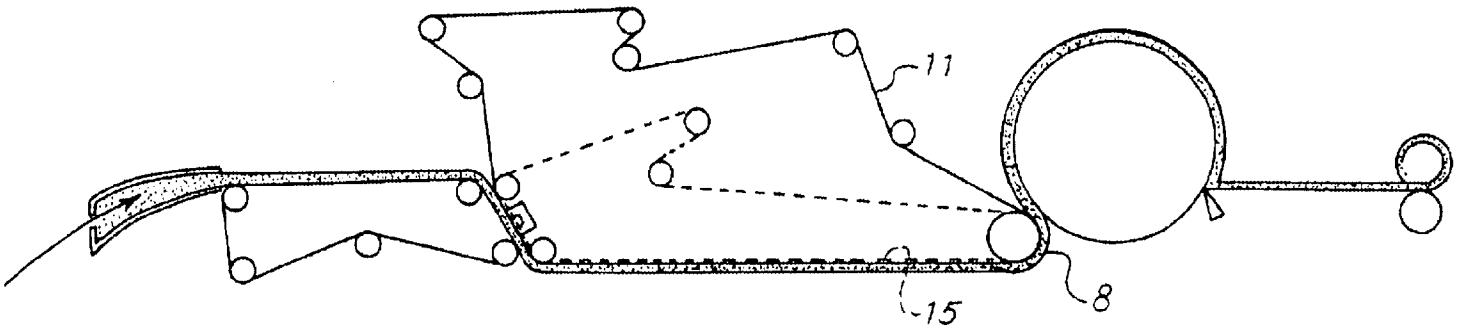
FIGS. 6 and 7 are schematic drawings of a section of a paper-making machine.
Figure 7:
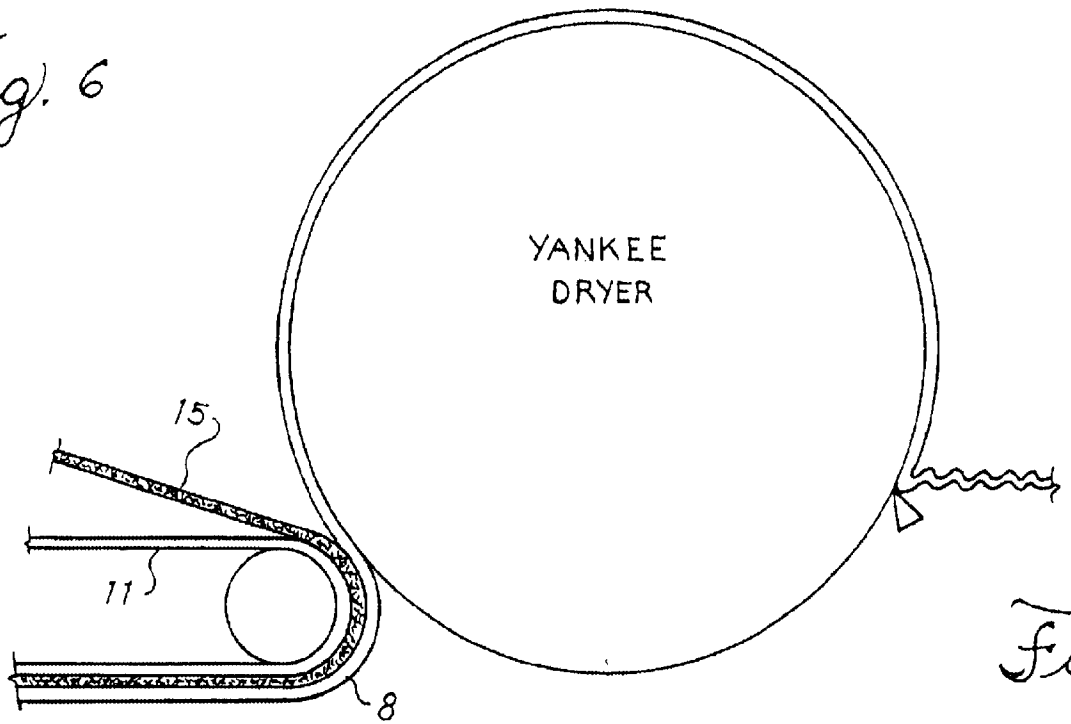

Referring again to FIG. 1, the wet web is uniformly adhered to the Yankee surface. This may be accomplished by using a solid smooth rubber roll or similar type press roll or wet press roll. Alternatively, a felt 15 may be placed underneath the transfer fabric 11, or between the transfer fabric 11 and the wet web 8 as shown in FIGS. 6 and 7. This felt has the effect of smoothly and uniformly attaching the wet web to the Yankee surface. The felt needs to apply uniform pressure against the sheet on the Yankee, without imparting any localized pressure or pressure patterns from the 3-dimensional structure of the felt. For example, a suitable felt that may be used would be a non-woven adhesively bonded material, such as a Saturated Fibrous Composite 262 type S-46913, 178#/2880, produced by Kimberly-Clark. The example of this type of material is similar to the material used in Jean labels, such as Jeans label Z6Z type S-46913.

The moisture content of the wet web at the point of adhesion to the Yankee should be from about 20 to about 60% solids, although slightly higher and lower percentage solids may also be usable depending upon dryer temperature and surface characteristics of the dryer. Additionally, creping aids or other processing aids may be used on the surface of the Yankee dryer.

Paper sheets can be made of long paper making fibers (softwood), short paper making fibers (hardwood), secondary fibers, other natural fibers, synthetic fibers, or any combination of these or other fibers known to those skilled in the art of paper making to be useful in making paper. Long paper making fibers are generally understood to have a length of about 2 mm or greater. Especially suitable hardwood fibers include eucalyptus and maple fibers. As used herein the term paper making fibers refers to any and all of the above.

As used herein, and unless specified otherwise, the term sheet refers generally to any type of paper sheet, e.g., tissue, towel facial, bath or a heavier basis weight product, creped or uncreped, blended, multilayer (one two, three or more layers) or single layered, and multiplied or singleplied. As used herein, and unless specified otherwise, the term tissue refers to all types of lower basis weight soft and absorbent paper sheets, whether or not know by that name, including without limitation bath or toilet tissue and facial tissue.

The uniformly smooth creped tissue product of the present invention has very low surface roughness, yet has significant stretch and is soft. For example, stretches in the range of about 15% to about 50% in the machine direction for a 15–20 gsm basis weight sheet (individual ply) may be obtained. The tissue has little or no discernable crepe, or crepe pattern, to the Yankee side of the sheet. The term "Yankee side" of the sheet refers to the side of the sheet that is adhered to dryer then creped from the dryer. This is evident when the tissue is viewed with the naked eye as well as under a microscope at 10×.

Figure 2A:
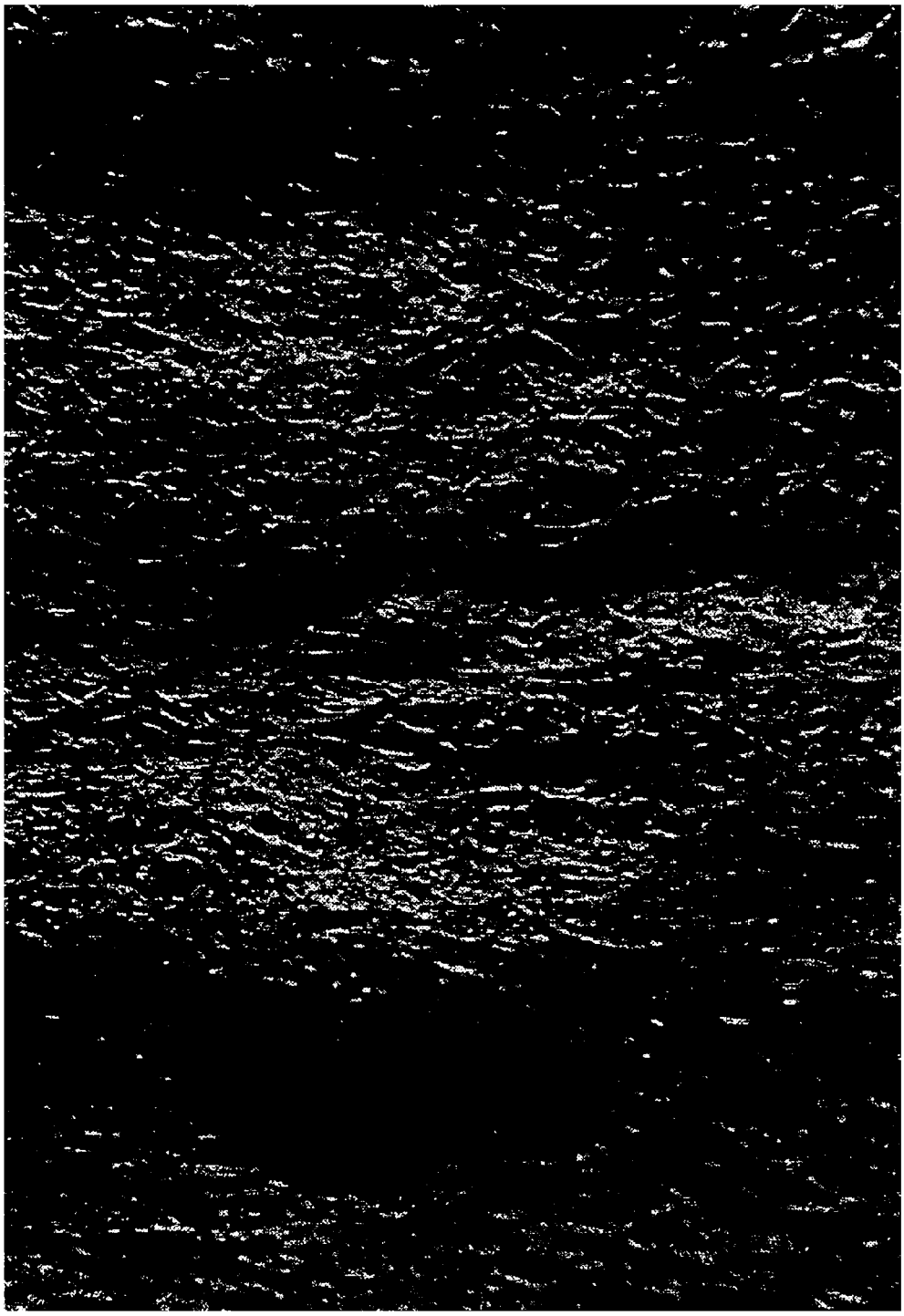
Figure 2B:
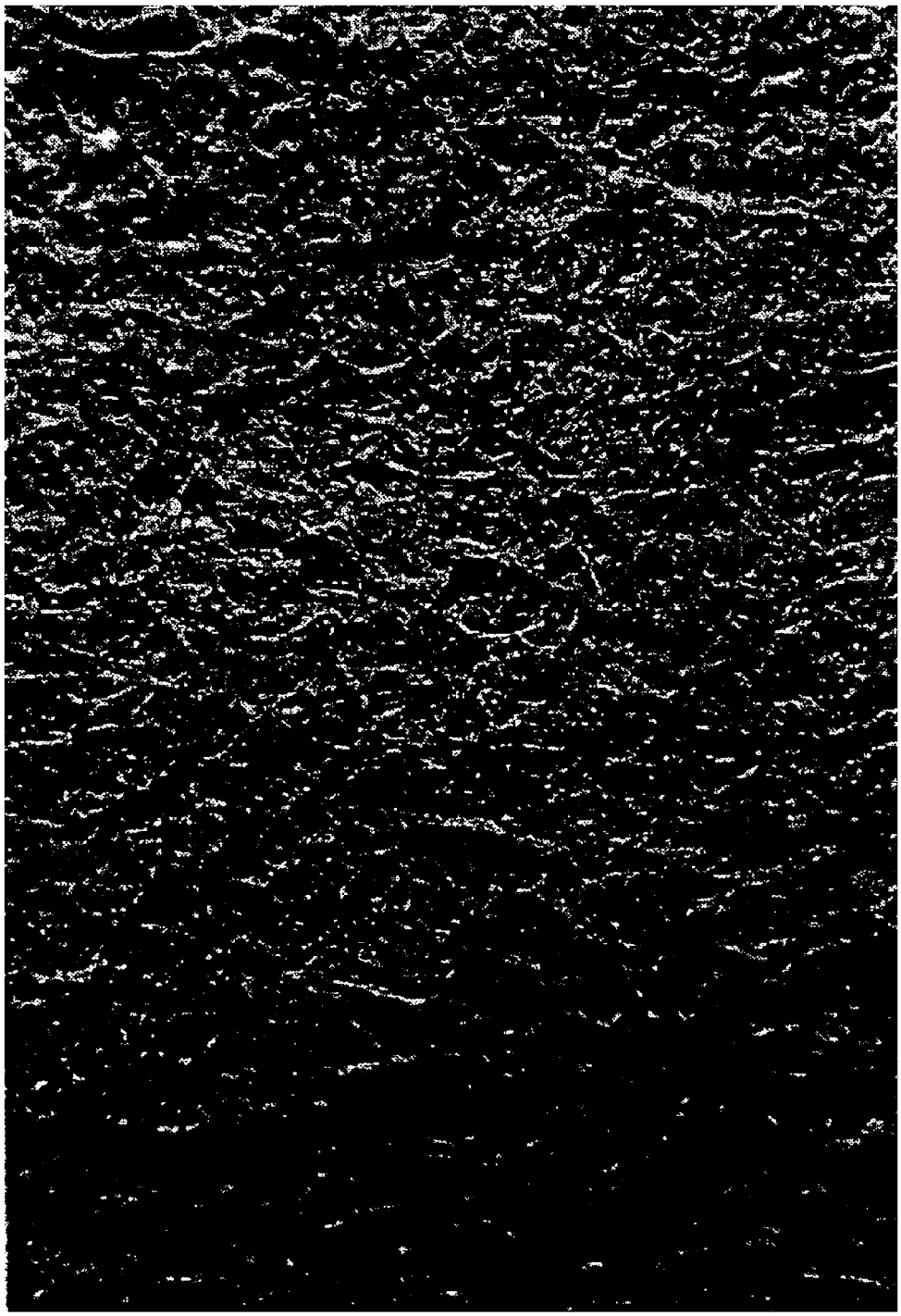
Figure 3:
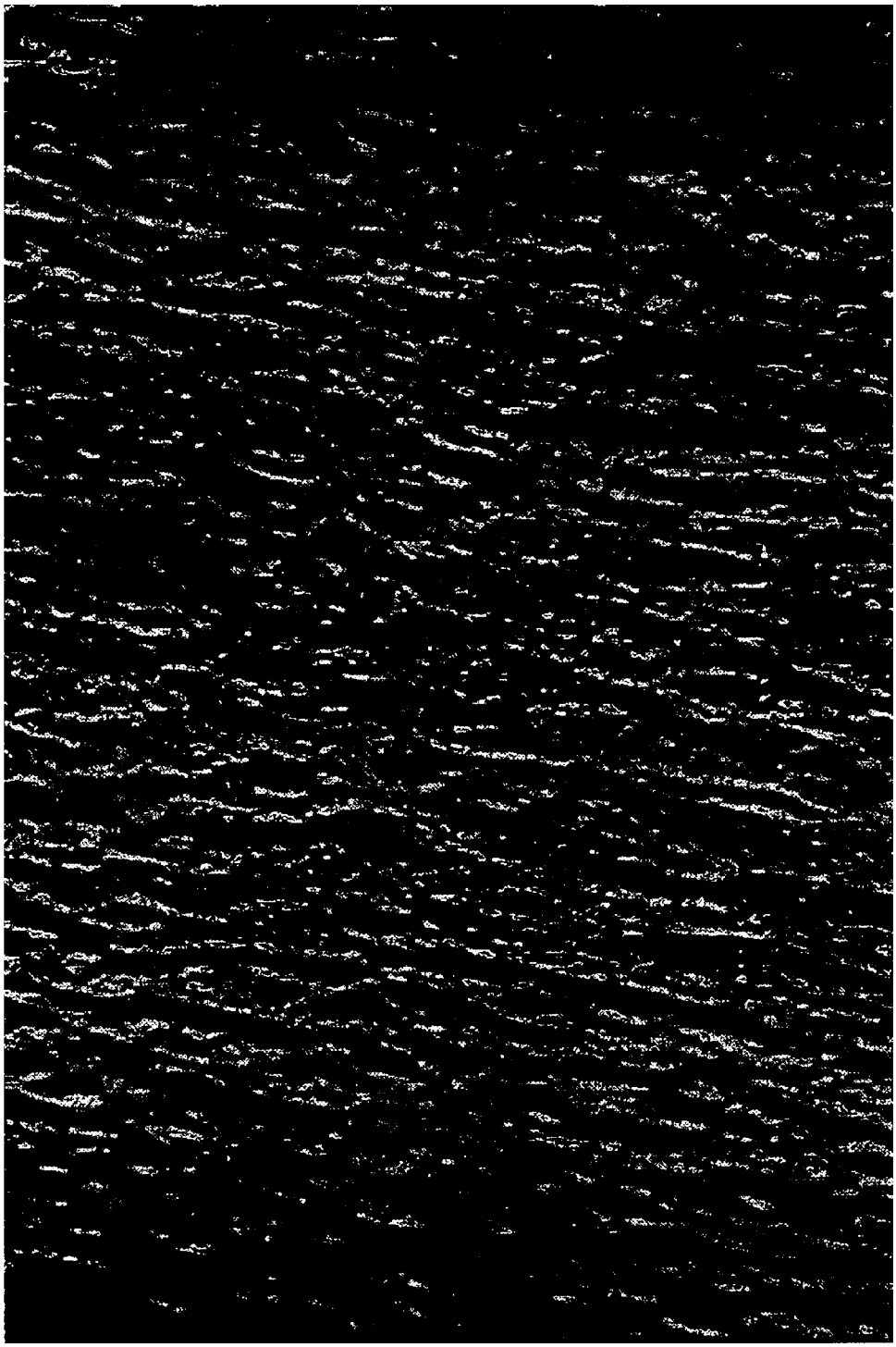
FIG. 3 is a photograph of the Yankee side surface of a conventional creped sheet. The lighting is oriented in the machine direction.

As can be seen from the photographs of FIGS. 2A and 2B (having the same magnification of the Yankee side surface of tissue coming within the scope of this invention with the light being oriented in the machine direction and at an oblique angle to the surface of the sheet) there is no crepe present. Instead, the sheet surface appears to be smooth with small random rises and falls having more the appearance of leather or a non-woven fabric (at zero magnification). In contrast, the crepe pattern is readily apparent in the tissue show in FIG. 3, which is also taken at the same magnification and lighting of the Yankee side of the sheet.

The sheet of the present invention has the appearance of a uniform smooth surface on the Yankee side to an observer either unaided, or at lower magnifications (in the range of about 10× to about 20×). Thus, the sheet has a Yankee surface that is creped from the Yankee and has the visual appearance of being uniform and smooth. The visual appearance of the Yankee side of the present invention is similar in appearance to the surface of an uncreped sheet of paper, such as for example, bond or writing paper.

The unique smooth surface feature of this tissue sheet may also be shown by computer assisted topographical or profilimitry analysis. This analysis focuses on the Yankee side of the sheet and provides a three dimensional analysis of the surface of the sheet.

Under this analysis, sheets having similar basis weights and creping blade conditions have roughness (Ra) values less than 30 $\mu$m, Ra values less than 25 $\mu$m and Ra values less than 15 $\mu$m for the Yankee side of the sheet. On the other hand, a conventional creped tissue, having similar furnish, basis weight, processing conditions, and creping blade conditions, and Ra test conditions may have an Ra value greater than the present invention for the Yankee side of the sheet.

Additionally, this analysis revealed that the uniformly smooth surface of the tissues has a substantially lower standard deviation regarding the height of the surface of the sheet than does a conventional creped tissue. That is to say, when looking at the variations in the height of the sheet surface, i.e., the changes in the "z" axis, if looking at the surface of the sheet from above, those changes will be substantially more uniform than that of a conventionally creped tissue. Thus, although a tissue of the present invention could exhibit the same or even greater overall surface roughness value Ra, the degree and severity of fluctuations in the z value would be such that the tissue of the present invention would have a substantially lower standard deviation with respect to that value.

The Ra values are obtained by an optical systems, such as a WYKO NT2000 scanning white light interference microscope or a Cadeyes System, as opposed to the using mechanical or styles type roughness measuring devices.

U.S. Pat. No. 5,779,965 describes the Cadeyes System, the disclosure of which is incorporated herein by reference.

Figure 4:
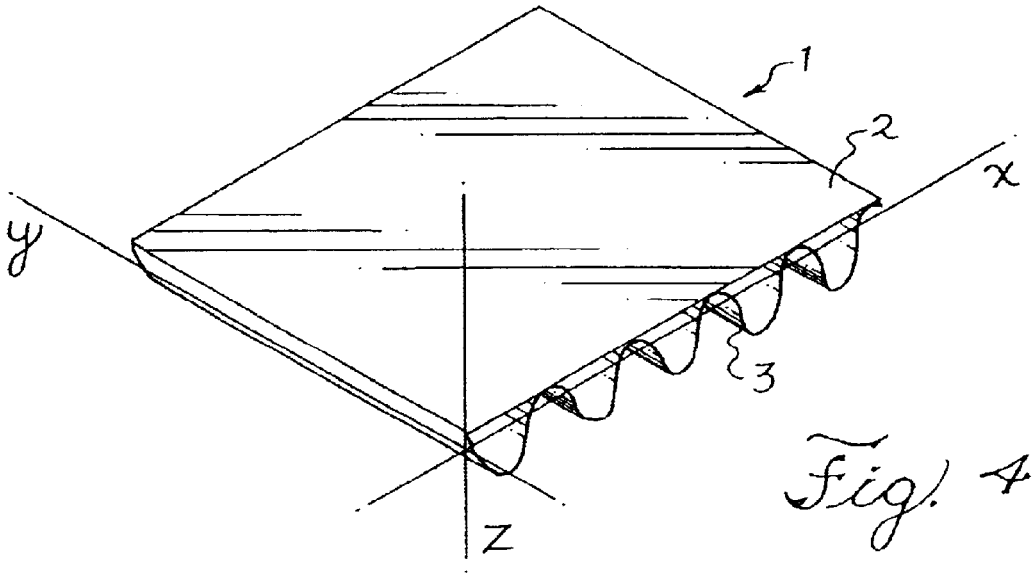
FIG. 4 is a prospective view sketch of a paper sheet of the present invention.
Figure 5:
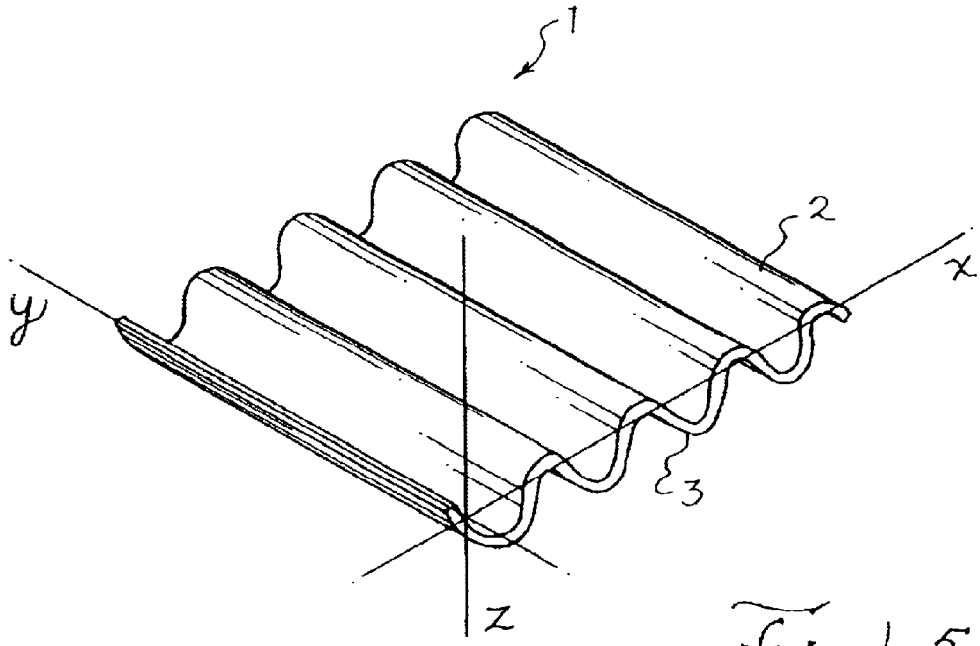
FIG. 5 is a prospective view sketch of a conventional creped paper sheet.

These features may also be further explained by reference to the sketches of paper sheets shown in FIGS. 4 and 5. FIG. 4 shows an example of a sheet 1 of the present invention while FIG. 5 shows a conventional creped sheet 1. Both sketches are enlarged and exaggerated from actual sizes of the sheets to more easily illustrate the structure of the sheets. The identifier numerals for both figures are the same, unless specifically noted otherwise. The machine direction is represented by the x axis and the cross-machine direction by the y axis.

From these figures it can be seen that Yankee side 2 of sheet 1 is substantially different between the conventional sheet of FIG. 5 and the present invention of FIG. 4. Thus, if the variation in the height of the Yankee sides of these sheets were measured (i.e., changes in the z direction) the amplitude of those charges is substantially smaller for the present invention than for a conventional sheet. On both sheets the crepe pattern can be seen in off-Yankee side 3 of sheet 1. The crepe pattern is also seen in Yankee side 2 of the conventional creped sheet in FIG. 5.

It has further been observed that with the tissues of the present invention a substantially smaller amount of the sheet surface is used to form the highest and lowest parts of that surface. Thus, in a conventional creped sheet about 20–30% of the surface of the sheet is found in the tops of the crepe ridges or in the bottom of the crepe troughs. In the uniformly smooth surface tissue of the present invention less than 10% of the sheet surface may make up the highest and the lowest points on the sheet.

Figure 8:
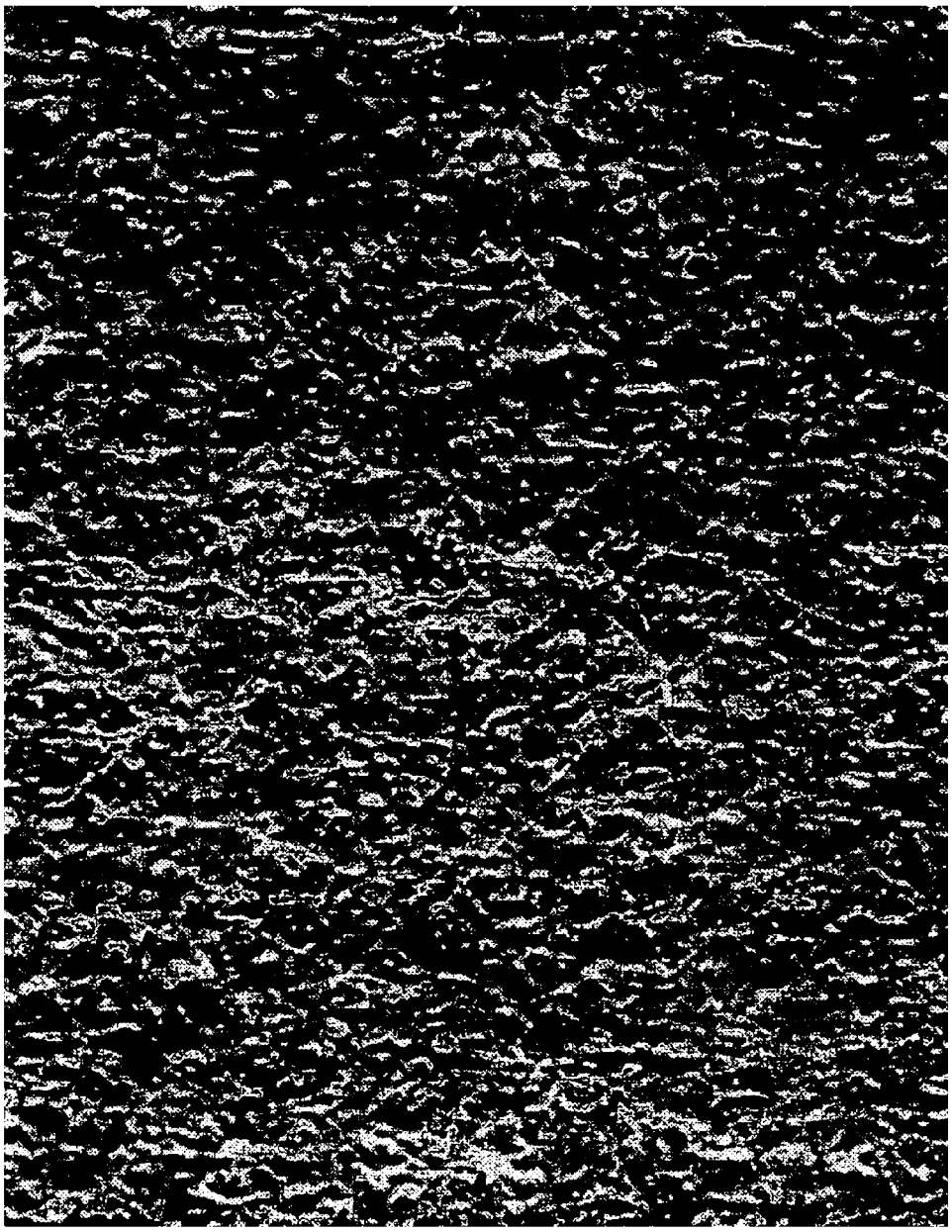
FIGS. 8, 9 and 10 are photographs of paper taken at 10×magnification, ¾ normal exposure, with the lighting in the machine direction and at a 15% angle from horizontal.
Figure 9:
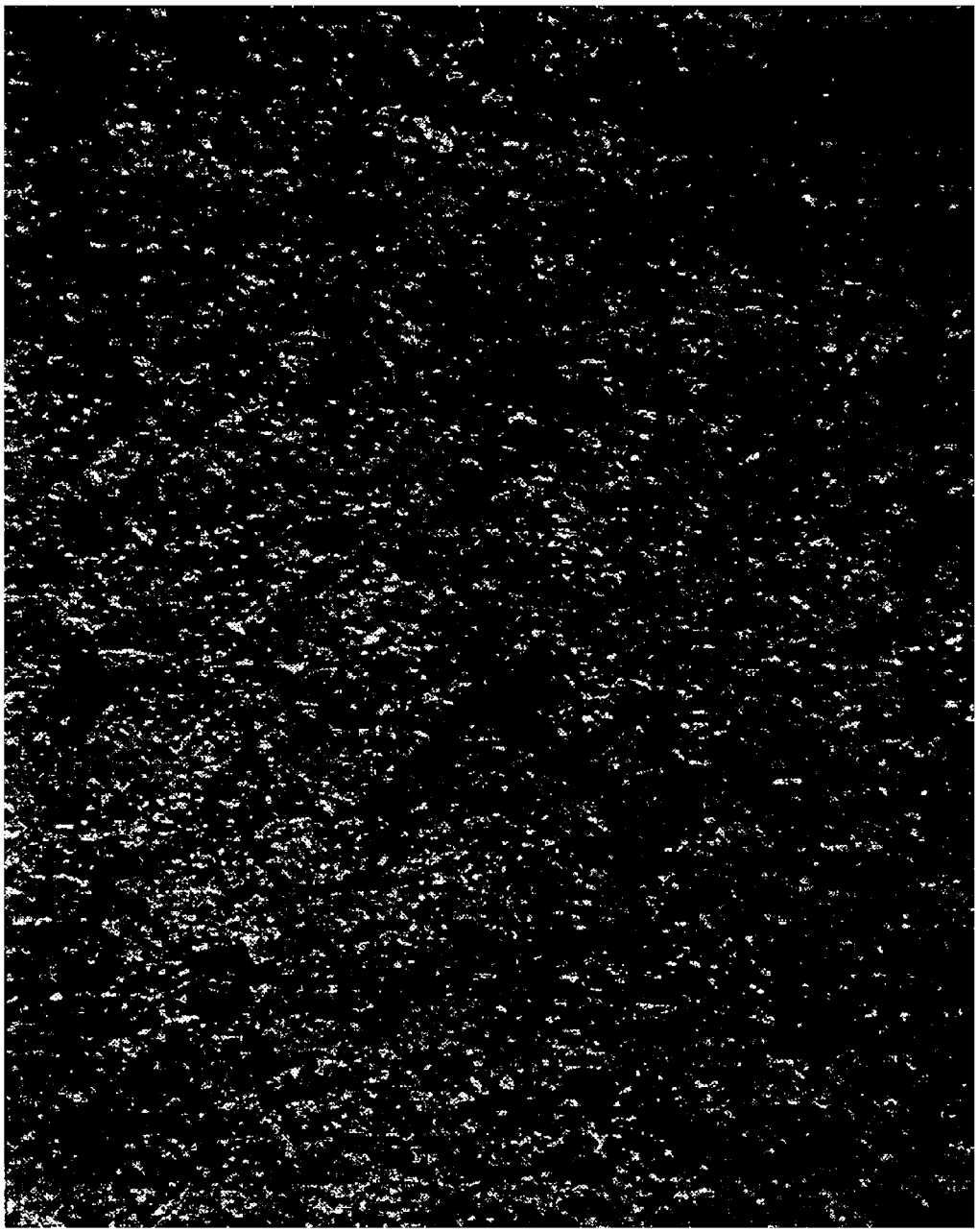
Figure 10:
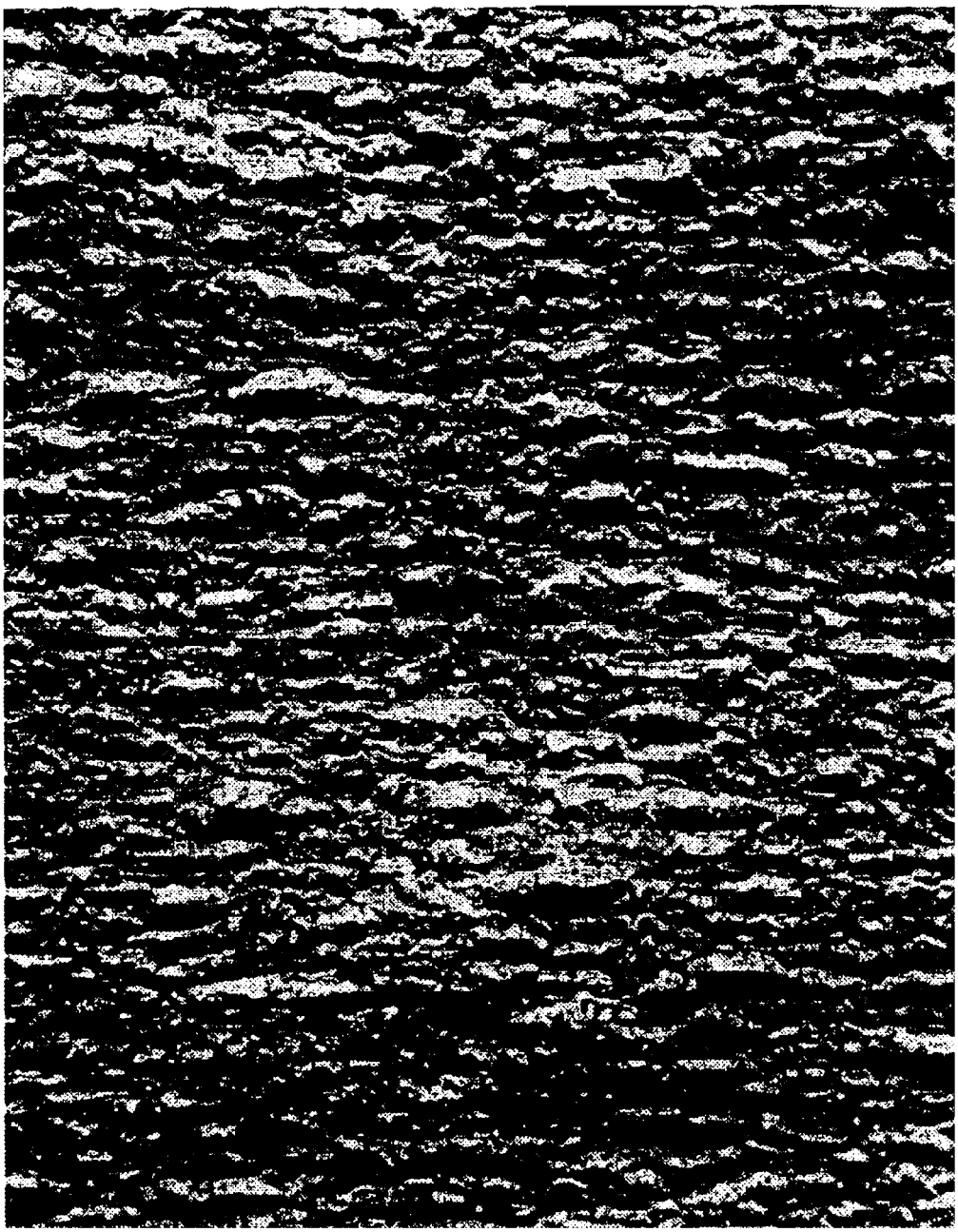

The visually smooth Yankee side surface of the sheet of the present invention appears very similar to that of a conventional bond or writing paper, which has not been creped. This is shown by comparing FIGS. 8, 9 and 10. FIG. 8 is a photograph of the Yankee side of the sheet of the present invention. This tissue has a machine direction stretch of about 39%. FIG. 9 is a photograph of a sheet of commercially available bond paper manufactured by Kimberly-Clark. This sheet was not creped and has a machine direction stretch of less than about 5%. FIG. 10 is a photograph of the Yankee side of creped tissue that is commercially available form Kimberly-Clark. These photographs, FIGS. 8, 9 and 10, as set forth in the description of the drawing section herein, were taken under the same magnification and lighting.

What is claimed is:

1. A tissue sheet having a basis weight from about 10 to 25 gsm, a bulk of from about 6 $cm^3/g$ to about 15 $cm^3/g$, and a stretch of from about 10% to about 50% in the machine direction; and comprising a Yankee side and an off-Yankee side; the Yankee side having a surface, said surface having a smooth appearance, said surface further being substantially free from any discernable crepe pattern.

2. A single ply creped tissue comprising:

a) a Yankee side and an off-Yankee side;

b) the Yankee side having a smooth appearance and further having no discernable crepe pattern when viewed with the naked eye;

c) the off-Yankee side having a crepe pattern that is visible to the naked eye;

d) a bulk of at least about 6 $cm^3/g$; and, f) a stretch of at least about 10% in the machine direction.

3. The tissue of claim 2 wherein the bulk is at least about 7 $cm^3/g$.

4. The tissue of claim 2 wherein the bulk is at least about 8 $cm^3/g$.

5. The tissue of claim 2 wherein the machine direction stretch is at least about 20%.

* * * * *